United States Patent [19]

Tellie

[11] 3,930,316

[45] Jan. 6, 1976

[54] SIGHTING MEANS OF A FIREARM

[75] Inventor: Paul E. Tellie, St. Etienne, France

[73] Assignee: Etat Francais, France

[22] Filed: May 17, 1974

[21] Appl. No.: 470,838

[30] Foreign Application Priority Data

June 1, 1973 France ..... 73.19960

[52] U.S. Cl. ..... 33/233; 33/251; 33/252

[51] Int. Cl.[2] ..... F41G 1/08; F41G 11/00

[58] Field of Search ..... 33/233, 244, 251, 252, 33/253

[56] References Cited

UNITED STATES PATENTS

| | | | |
|---|---|---|---|
| 727,073 | 5/1903 | Brayton | 33/233 |
| 971,287 | 9/1910 | Lovejoy | 33/253 |
| 1,012,427 | 12/1911 | Peddie | 33/233 |
| 1,540,772 | 6/1925 | Gibbs | 33/233 |

FOREIGN PATENTS OR APPLICATIONS

| | | | |
|---|---|---|---|
| 1,919,031 | 10/1970 | Germany | 33/251 |
| 1,008,009 | 10/1965 | United Kingdom | 33/251 |

*Primary Examiner*—Richard E. Aegerter
*Assistant Examiner*—Richard R. Stearns
*Attorney, Agent, or Firm*—Stevens, Davis, Miller & Mosher

[57] ABSTRACT

The rear sight of a firearm has a peephole device formed by a hollow tube, each of the two ends of which are closed by a peephole. Each peephole has a central orifice therein. The orifice of the peephole of the rear side has a larger diameter than the orifice of the peephole on the front sight side. Each peephole is pivotally mounted and cooperates with an elastic member which holds the peephole in its tube-opening or tube-closing position. In a further embodiment, two peepholes are provided at each end of the tube.

10 Claims, 7 Drawing Figures

FIG. 3
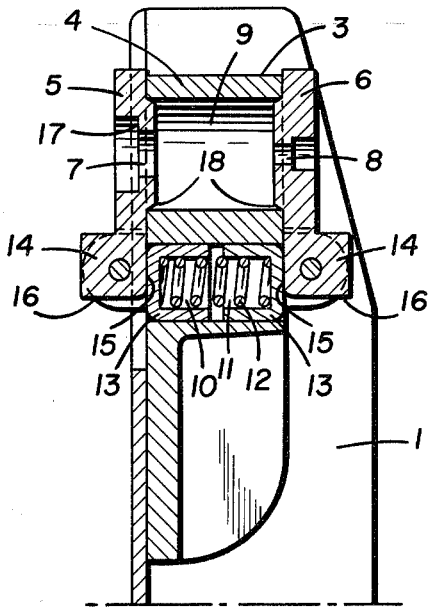
FIG. 4
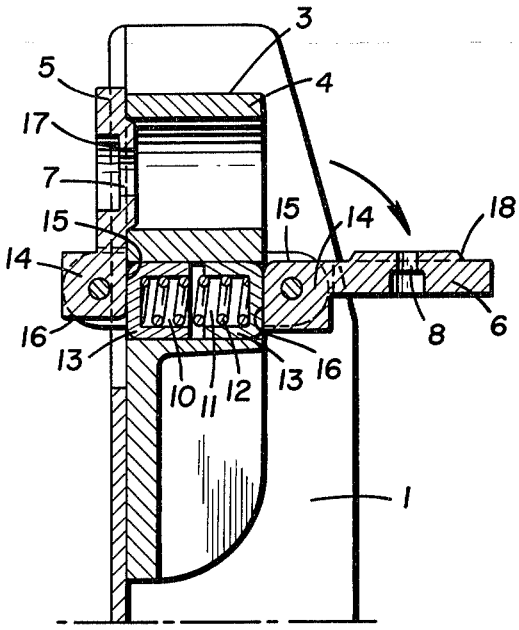
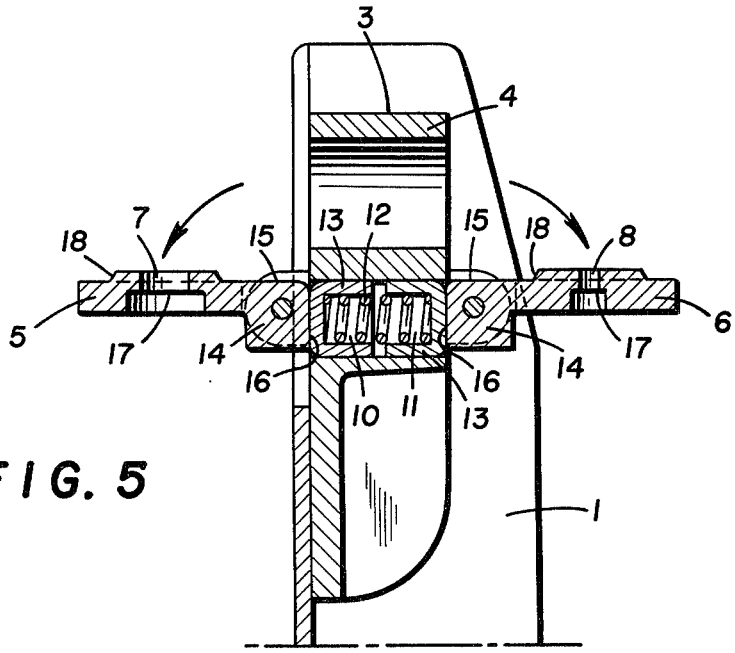
FIG. 5

SIGHTING MEANS OF A FIREARM

The present invention relates to sighting means for a firearm, which means comprise a rear sight and a front sight.

The invention applies more particularly, since it is in this case that its application would seem to be of the greatest interest, but not exclusively, to sighting devices for small-caliber firearms such as rifles, carbines, machine pistols or automatic rifles.

It is known, as a matter of fact, that the present trend in the manufacture of such firearms is to reduce the length of the barrels. Today barrel lengths are between about 50 and 100 times the caliber of the weapon. Thus, for a 5.56 caliber weapon, the length of the barrel is about 40 cm.

Under these conditions it will be seen that the length of the line of sight between the rear sight and front sight is reduced as compared to that which might be found on firearms having a much longer barrel.

The sighting therefore has a tendency to be less precise.

In order to improve the accuracy of the sighting, it has already been proposed to provide the rear sight with a peephole formed by a diaphragm having a central orifice.

In order to change the characteristics of the line of sight there have been proposed rear sights which are adapted to receive interchangeable diaphragms whose orifices have different diameters. For the same purpose it has also been proposed to equip the rear sights with a rotating diaphragm provided with a plurality of orifices.

Various other artifices such as bonnets arranged on the side of the diaphragm facing the eye of the marksman have been proposed in order to improve the precision of the sighting.

The object of the present invention is to provide sighting devices which make it possible to further increase the precision of the sighting and to overcome the drawbacks presented by a line of sight which is shorter than the line of sight of a conventional weapon.

Still another object of the invention is to provide sighting devices which permit adaptation to the conditions of light present upon firing (firing in full sunlight, firing in a shadow, nighttime firing).

The sighting devices in accordance with the invention comprise a rear sight having a peephole device and a front sight and they are characterized by the fact that the peephole device is formed by a hollow tube, the two ends of which are each closed by a peephole, with each of the peepholes having a central orifice, and the orifice of the peephole on the side of the marksman being of a diameter greater than the orifice of the peephole on the side of the front sight.

It will be seen then that one obtains a peephole device having two orifices separated by a dark chamber, which considerably reduces the effects of the diffraction of the rays of light at the edges of the orifice of smaller diameter, and thus considerably improves the accuracy of the sighting.

In accordance with a preferred embodiment of the invention, the inner diameter of the hollow tube is between 5 and 15 mm, and its length is approximately equal to its inside diameter.

One advantageous arrangement of the invention consists in removably mounting at least one of the two peepholes so that it is possible to open one and/or both ends of the hollow tube.

These two peepholes may be pivotally mounted and cooperate with elastic members which hold them either in the tube closing position or in the tube-opening position.

It is then possible to impart to the tube an inside diameter greater than the diameter of the pupil of the human eye at its maximum aperture, with the said tube then serving as a peephole for firing under conditions of very poor light, such as night firing.

From a construction standpoint, it is advantageous to impart to the central orifice of each peephole a shape such that its diameter on the side of the inner face of the peephole (tube side) is less than its diameter on the side of the outer face of the peephole (side opposite the tube). For this purpose, the central orifice may have a central shoulder.

In order to obtain a precise centering of each peephole and avoid the introduction of light into the dark chamber, each peephole has a boss which fits in the tunnel.

Another arrangement in accordance with the invention consists in providing two (or more) peepholes at each end respectively of the tube, with these two peepholes being mounted in such a manner that they can close off the end in question of the tube by one or the other of them coming into place at said end, or by coming one on top of the other.

In this latter case, the peephole which is further to the outside will therefore cover the peephole which is further to the inside, and its orifice will then have a shorter diameter than the orifice of the diaphragm further to the inside.

The possibilities of use of a firearm in accordance with the invention are then numerous, since the marksman can use it:

— with the peephole device formed of two orifices separated by a dark chamber (if a single peephole is mounted at each end of the tube, one has a single combination; if two or several peepholes are mounted at each end of the tube, one then has two or more than two combinations to constitute this peephole device);

— with the peephole device formed of the simple tube;

— with the peephole device formed of the tube closed at only one of its ends with one or the other of the peepholes (if a single peephole is mounted at each end of the tube, one has two combinations to constitute this peephole device; but if two or more peepholes are mounted at each end of the tube, one has four or more than four combinations to constitute this peephole device).

Aside from the arrangements which have just been mentioned above, the invention consists of several other arrangements which will be described in further detail below and which are preferably employed simultaneously.

The invention will in any event be better understood from the further description which follows, as well as from the accompanying drawings, the said description and drawings relating to preferred embodiments of the invention and, of course, not being in any way limitative.

FIG. 1 of the drawings is a simplified view of a firearm developed in accordance with the invention.

FIG. 3 is a more detailed section on a larger scale through a first embodiment of the rear sight shown schematically in FIG. 2, this sight being shown in a first configuration.

FIGS. 4 and 5 are two sections through the rear sight of FIG. 3, showing two other configurations.

Figure 2:
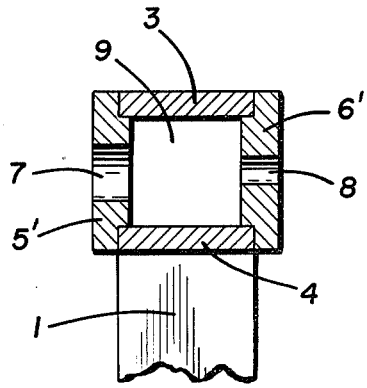
FIG. 2 is a schematic view of the rear sight of the firearm shown in FIG. 1.
Figure 7:
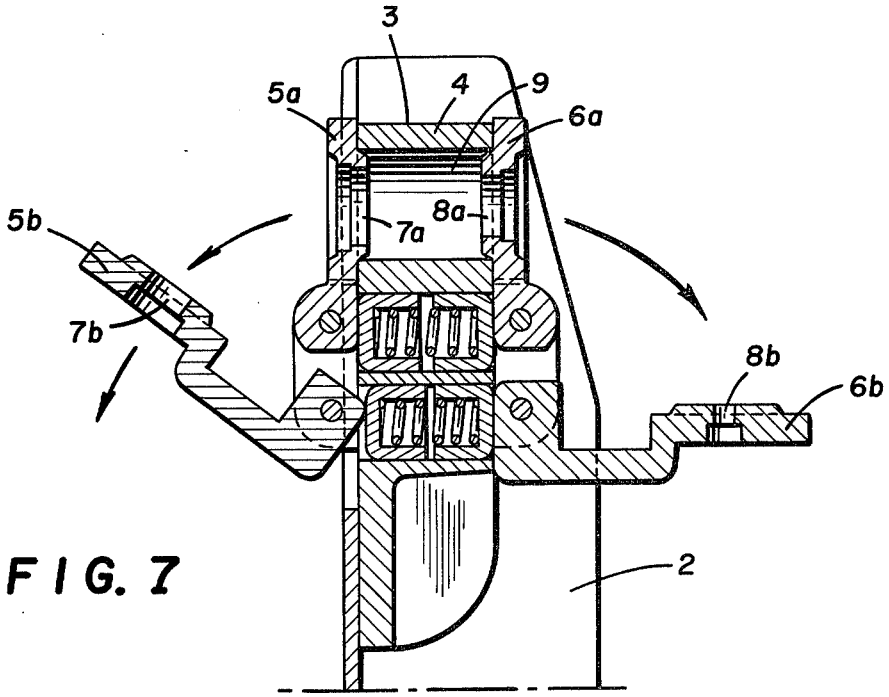

FIG. 7, finally, is a cross section through the rear sight of FIG. 2, showing a different configuration.

DESCRIPTION OF THE PREFERRED EMBODIMENT

Figure 1:
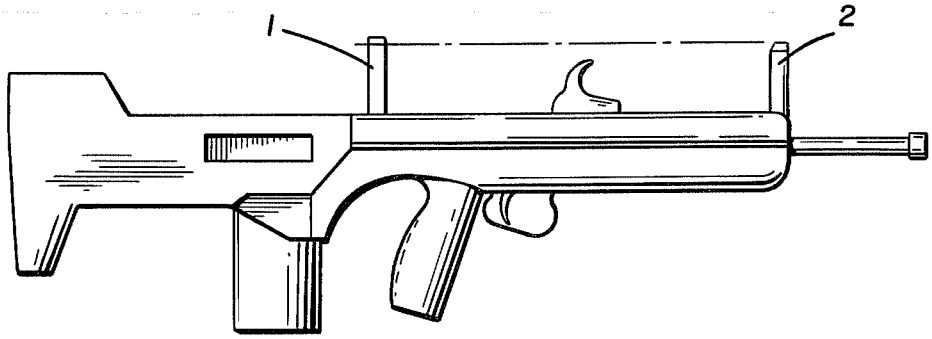

FIG. 1 shows a firearm the sighting devices of which comprise a rear sight 1, which is possibly adjustable in height and direction by conventional means (not shown), and a front sight 2.

As shown in FIG. 2, the rear sight 1 is provided with a peephole device 3 formed by a hollow tube 4 whose two ends are closed by two peepholes 5′ and 6′ respectively.

Each peephole has a central orifice 7 and 8 respectively, the orifice 7 of the peephole 5′, which is on the marksman's side, being of a larger diameter than the orifice 8 of the peephole 6′ which is on the side towards the front sight 2.

The peephole device 3 thus obtained is then formed of the two orifices 7 and 8 separated by a dark chamber 9.

The inside diameter of the tube 4 is advantageously between 5 and 15 mm, its length being approximately equal to its inside diameter.

As shown in FIGS. 3, 4 and 5, the two peepholes 5 and 6 are removable so that it is possible to open one and/or the other end of the tube 4.

This possibility of opening one or both ends of the tube 4 makes it possible in particular to effect the cleaning thereof in the event that dust or the like should enter the dark chamber 9.

The two peepholes 5 and 6 are advantageously mounted for pivoting and they cooperate with elastic members 10 and 11 respectively which hold them either in the position in which they close the tube 4 or in the position in which the tube 4 is open.

It is then possible to impart to the tube 4 an inside diameter which is greater than the diameter of the pupil of the human eye at its maximum aperture (about 7 mm), the tube 4 then serving as a peephole device for nighttime firing when the two peepholes 5 and 6 are in open position.

These elastic members 10 and 11 may consist of springs 12 acting on push members 13 which cooperate with the peepholes 5 and 6. For this purpose, each of the peepholes 5 and 6 has an extension 14 traversed by the pivot pin of the peephole in question. The extension 14 has two flat faces 15, 16 which together form an angle corresponding to the angle between the two positions of the peephole. These two flat faces 15 and 16 cooperating with the push member 13 and the angle formed by these two flat faces 15 and 16 may advantageously be 90°.

From a structural standpoint, the central orifice 7 or 8 of the peephole 5 or 6 has a shape such that its diameter on the side of the inner face of the peephole (tunnel side) is less than its diameter on the side of the outer face of the peephole (side opposite the tube) and, for this purpose, the orifice may have a central shoulder 17.

In order to obtain a precise centering of each peephole 5 or 6 and avoid the introduction of light into the dark chamber 9, each peephole has a boss 18 which fits into the tube 4.

With respect to the mounting of the peepholes 5 and 6, it may be mentioned that they are mounted around horizontal pivot pins perpendicular to the line of sight and located below said line. In accordance with another arrangement of the invention, illustrated in FIGS. 6 and 7, two peepholes 5*a* and 5*b* are provided at one of the ends of the tube 4 (marksman's side) and two peepholes 6*a* and 6*b* are provided at the other end of the tube 4 (front-sight side).

These four peepholes 5*a*, 5*b* and 6*a*, 6*b* are pivotally mounted so that they can close the end of the tube 4 in question by coming one onto the other, the peepholes 5*a* and 6*a* being located furthest towards the inside with respect to the tube 4, while the peepholes 5*b* and 6*b* are located furthest to the outside with respect to the tube 4.

For this purpose, the two pivot pins of the two peepholes 5*a* and 5*b*, as well as the two pivot pins of the two peepholes 6*a* and 6*b*, are horizontal, perpendicular to the line of sight, and both located below the line of sight. From a structure standpoint, the two peepholes furthest to the outside, namely 5*b* and 6*b*, are adapted to present a recess which fits over the extension 14 of the two peepholes furthest to the inside, namely 5*a* and 6*a*.

The peephole 5*b* which is furthest to the outside can therefore cover the peephole 5*a* which is furthest to the inside, and it is then advantageous to impart to its orifice 7*b* a smaller diameter than the diameter of the orifice 7*a* of the peephole 5*a* furthest to the inside. Likewise, the peephole 6*b*, which is furthest to the outside, can cover the peephole 6*a* which is furthest to the inside, and it is advantageous to impart to its orifice 8*b* a diameter smaller than the diameter of the orifice 8*a* of the peephole 6*a* which is furthest to the inside.

The possibilities of use of a firearm developed in the manner which has just been described are then multiplied, since the marksman may use it:

— with the peephole device formed by the two orifices 7 and 8 of the two peepholes 5 and 6 (FIG. 3), — with the peephole device formed by the two orifices 7*a* and 8*a* of the two peepholes 5*a* and 6*a* (FIG. 7), — with the peephole device formed by the two orifices 7*b* and 8 *b* of the two peepholes 5*b* and 6*b* (FIG. 6), — with the peephole device formed by the orifice 7 of the peephole (FIG. 4), and — with the peephole device formed by the tube 4 (FIG. 5).

Aside from these possible uses which have been illustrated, others could be mentioned which are not illustrated, but the manner of production of which can easily be imagined.

The configuration illustrated in FIG. 3 corresponds to sighting under good lighting conditions.

The configuration illustrated in FIG. 7 corresponds to sighting under poor lighting conditions, as the diameters of the orifices of the peepholes are larger than those of the orifices of the peepholes of FIG. 3.

Figure 6:
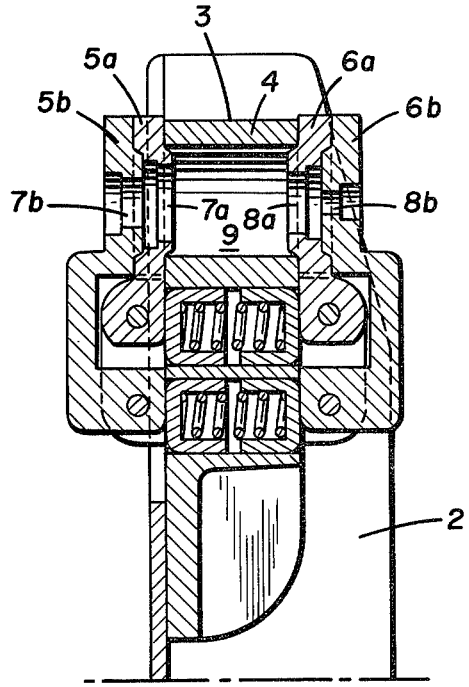
FIG. 6 is a more detailed section on a larger scale of another embodiment of the rear sight shown schematically in FIG. 2, shown in a first configuration.

The configuration illustrated in FIG. 6 corresponds to sighting with better lighting conditions, as the diameter of the orifice of the peephole on the side of the marksman is smaller than the diameter of the orifice of the corresponding peephole of FIG. 3.

The configuration illustrated in FIG. 4 corresponds to sighting under poor lighting conditions, as the marksman has selected a single peephole whose orifice has a relatively large diameter.

The configuration illustrated in FIG. 5 corresponds to sighting under minimum lighting conditions (night-time firing), as the marksman sights through the tube which has a diameter greater than that of the pupil of his eye which is then opened to the maximum.

Finally, whatever the embodiment adopted, one has a firearm the sights of which are adaptable to various lighting conditions and which always make it possible to effect sighting with greater precision than the sights of conventional firearms.

Furthermore, it is of interest to note that whatever the combination selected to constitute the peephole device, the latter is always firmly connected with the mechanism for the regulating of the height and direction of the rear sight.

As goes without saying, and as is furthermore evident from the foregoing, the invention is by no means limited to those of its embodiments or applications which have been more particularly contemplated; rather, it covers all possible variants.

I claim:

1. A firearm comprising a rear sight having a peephole device and a front sight, said peephole device comprising a hollow tube and two peepholes, the two ends of said hollow tube being closed by said peepholes, each of said peepholes having a central circular orifice therein, the orifice on the peephole on the rear side being of a larger diameter than the orifice on the peephole on the front sight side, at least one of the two peepholes is removable, at least one of the two peepholes is pivotally mounted with respect to said peephole device, and an elastic means for selectively holding said pivotally mounted peephole in either a tube-closing or a tube-opening position.

2. A firearm as claimed in claim 1, wherein the inside of said tunnel is circular in cross-section and the inside diameter of the tunnel is between 5 and 15 mm.

3. A firearm as claimed in claim 2, wherein the length of the tube is approximately equal to its inside diameter.

4. A firearm as in claim 1, wherein the inside of said tube is circular and the tunnel has an inside diameter which is greater than the diameter of the pupil of the human eye at its maximum aperture.

5. A firearm comprising a rear sight having a peephole device and a front sight, said peephole device comprising a hollow tube and two peepholes, the ends of said hollow tube being closed by said peepholes, each of said peepholes having a central circular orifice therein, the orifice on the peephole on the rear side being of a larger diameter than the orifice on the peephole on the front sight side, the diameter of the central orifice of each peephole on the side of the inner face of the peephole (tube side) is less than its diameter on the side of the outer face of the peephole (side opposite the tube), and the central orifice of each peephole has a median shoulder.

6. A firearm as in claim 5, wherein each peephole has a boss which fits in the tube.

7. A firearm comprising a rear sight having a peephole device and a front sight, said peephole device comprising a hollow tube and four peephole members, each end of said hollow tube being respectively closed by two aligned separate peephole members of said four peephole members, each of said peephole members having a central circular orifice therein, the orifice on one of the peephole members on the rear side being of a larger diameter than the orifice on one of the peephole members on the front sight side.

8. A firearm as in claim 7, wherein the two peephole members at each end of the tube individually close on adjustable mounting means for positioning each peephole member in either a tube closing or tube opening position.

9. A firearm as in claim 7 wherein the outer of said two peephole members at each end of the tube mounted is on adjustable mountings means for positioning said outer peephole members onto the other peephole member for closing the end of the tube or in a tube opening position.

10. A firearm as claimed in claim 9, wherein the one of the two peephole members at each end of the tube that is furthest to the outside has an orifice of smaller diameter than the orifice of the other peephole member that is furthest to the inside.

* * * * *